US010626816B2

(12) United States Patent
Surnilla et al.

(10) Patent No.: US 10,626,816 B2
(45) Date of Patent: Apr. 21, 2020

(54) SYSTEMS AND METHODS FOR COMPRESSION HEATED AIR

(71) Applicant: Ford Global Technologies, LLC, Dearborn, MI (US)

(72) Inventors: Gopichandra Surnilla, West Bloomfield, MI (US); Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 61 days.

(21) Appl. No.: 15/922,775

(22) Filed: Mar. 15, 2018

(65) Prior Publication Data

US 2019/0285016 A1 Sep. 19, 2019

(51) Int. Cl.

| | |
|---|---|
| ***F02D 41/00*** | (2006.01) |
| ***F02D 41/06*** | (2006.01) |
| ***F02D 17/02*** | (2006.01) |
| ***F02D 13/06*** | (2006.01) |
| ***F02D 41/26*** | (2006.01) |
| ***F02D 35/02*** | (2006.01) |
| ***F02D 13/02*** | (2006.01) |
| ***F02N 11/08*** | (2006.01) |
| ***F02N 19/00*** | (2010.01) |
| *F02B 75/02* | (2006.01) |

(52) U.S. Cl.

CPC ..... *F02D 41/068* (2013.01); *F02D 13/0211* (2013.01); *F02D 13/06* (2013.01); *F02D 17/023* (2013.01); *F02D 35/023* (2013.01); *F02D 35/026* (2013.01); *F02D 41/0087* (2013.01); *F02D 41/064* (2013.01); *F02D 41/26* (2013.01); *F02N 11/08* (2013.01); *F02N 19/004* (2013.01); *F02B 2075/027* (2013.01); *F02D 2013/0292* (2013.01); *F02D 2041/0012* (2013.01); *F02D 2200/0402* (2013.01); *F02D 2200/0414* (2013.01); *F02D 2250/24* (2013.01)

(58) Field of Classification Search

CPC ..... F02D 41/068; F02D 41/064; F02D 13/06; F02D 17/023; F02D 2013/0292

See application file for complete search history.

(56) References Cited

U.S. PATENT DOCUMENTS

| | | | |
|---|---|---|---|
| 5,117,790 A | 6/1992 | Clarke et al. | |
| 7,900,598 B2 | 3/2011 | Lewis et al. | |
| 10,301,991 B1 * | 5/2019 | Dudar | F02B 37/183 |

(Continued)

FOREIGN PATENT DOCUMENTS

CN 105715386 A 6/2016

*Primary Examiner* — Phutthiwat Wongwian
*Assistant Examiner* — Sherman D Manley
(74) *Attorney, Agent, or Firm* — Geoffrey Brumbaugh; McCoy Russell LLP

(57) ABSTRACT

Methods and systems are provided for compression heating of air. In one example, a method may include, during an engine start and prior to a first combustion event, deactivating cylinder exhaust valves while spinning the engine electrically and unfueled until a threshold intake air temperature is reached, and alternately activating and deactivating the exhaust valves of one or more cylinders to maintain the intake air temperature above the threshold temperature after the first combustion event. In this way, a temperature of an air charge may be increased, resulting in increased fuel economy and decreased vehicle emissions.

19 Claims, 5 Drawing Sheets

(56) References Cited

U.S. PATENT DOCUMENTS

| | | | | |
|---|---|---|---|---|
| 2003/0041829 | A1* | 3/2003 | Marshall | F01L 13/065 123/179.3 |
| 2003/0183185 | A1* | 10/2003 | Sun | F01L 9/02 123/179.16 |
| 2005/0205069 | A1* | 9/2005 | Lewis | F01L 1/38 123/491 |
| 2007/0056533 | A1* | 3/2007 | Reed | F02D 41/008 123/21 |
| 2007/0107687 | A1* | 5/2007 | Lewis | B60W 10/06 123/179.16 |
| 2008/0060609 | A1* | 3/2008 | Surnilla | F01L 9/04 123/299 |
| 2011/0088661 | A1* | 4/2011 | Sczomak | F02D 13/06 123/481 |
| 2018/0171887 | A1* | 6/2018 | Ulrey | F02M 26/14 |

* cited by examiner

SYSTEMS AND METHODS FOR COMPRESSION HEATED AIR

FIELD

The present description relates generally to methods and systems for gas heating via a vehicle engine.

BACKGROUND/SUMMARY

An efficiency of a vehicle engine may be reduced during a cold start and/or prior to the engine reaching steady state operating temperatures. For example, combustion may be less complete when the engine is started compared with when the engine is warmed up, reducing fuel economy and increasing vehicle emissions. In particular, the engine may be run intermittently when the vehicle is a hybrid, equipped with a stop/start system, etc., which may result in multiple engine starts within a single drive cycle. Therefore, systems and methods that increase combustion efficiency during initial operation are of increasing importance. Factors that influence combustion completion include combustion chamber wall temperature, combustion air temperature, fuel temperature, and engine speed. In particular, heating the combustion air (e.g., air used in a combustion reaction within an engine cylinder) may increase combustion completion due to the influence of the combustion air temperature on mixture preparation and air charge reduction.

Other attempts to address air heating include operating in an air heating mode during a starting sequence of an engine. One example approach is shown by Clarke et al. in U.S. Pat. No. 5,117,790. Therein, one or more cylinders of a multi-cylinder engine are operated in the air heating mode prior to initiating combustion within the one or more cylinders by deactivating their exhaust valves. Once each of the one or more cylinders is sufficiently heated, the corresponding exhaust valves are activated and fuel is injected to initiate combustion. Additional cylinder(s) may then be operated in the air heating mode prior to initiating combustion in the additional cylinder(s).

However, the inventors herein have recognized potential issues with such systems. As one example, sequentially heating and initiating combustion in the cylinders of a multi-cylinder engine may prolong engine start times, resulting in decreased vehicle operator satisfaction. Furthermore, the engine may benefit from continued air heating even after the first combustion event, especially while the engine remains below steady state operating temperatures. Further still, hotter combustion air temperatures may aid certain ignition strategies, such as compression ignition strategies, even while the engine is warmed up.

In one example, the issues described above may be addressed by a method for a hybrid electric vehicle, comprising: during an engine start, deactivating engine cylinder exhaust valves while activating engine cylinder intake valves and electrically spinning the engine unfueled until reaching a threshold intake air temperature; and, after reaching the threshold intake air temperature, activating and fueling one or more of the cylinders to initiate combustion, and then alternating between deactivating and combusting in the one or more cylinders until reaching a threshold engine temperature. In this way, the engine may be efficiently started and with increased combustion completion.

As one example, alternating between deactivating and combusting in the one or more cylinders includes maintaining the exhaust valves of the one or more cylinders closed while the corresponding intake valves remain active and disabling fueling to the one or more cylinders over an engine cycle; and lifting the intake valve and the exhaust valve at corresponding valve timings, providing fuel via a fuel injector coupled to each of the one or more cylinders, and providing spark via a spark plug coupled to each of the one or more cylinders over the subsequent engine cycle. By alternately deactivating and combusting in the one or more cylinders, continued air heating may be provided even after the engine is started and combustion is initiated. For example, the threshold engine temperature may be a steady state operating temperature of the engine. Thus, continued air heating may be provided when the engine is colder. In contrast, air heating prior to a first combustion event may be performed independent of the engine temperature. In this way, the air heating prior to the first combustion event may be provided even when the engine has not substantially cooled, such as when the engine is shut down and restarted while the vehicle remains on. In still other examples, the continued air heating may be provided to facilitate operation in a compression ignition mode in which increased air charge temperatures may aid compression ignition. Overall, fuel economy may be increased and vehicle emissions may be reduced.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
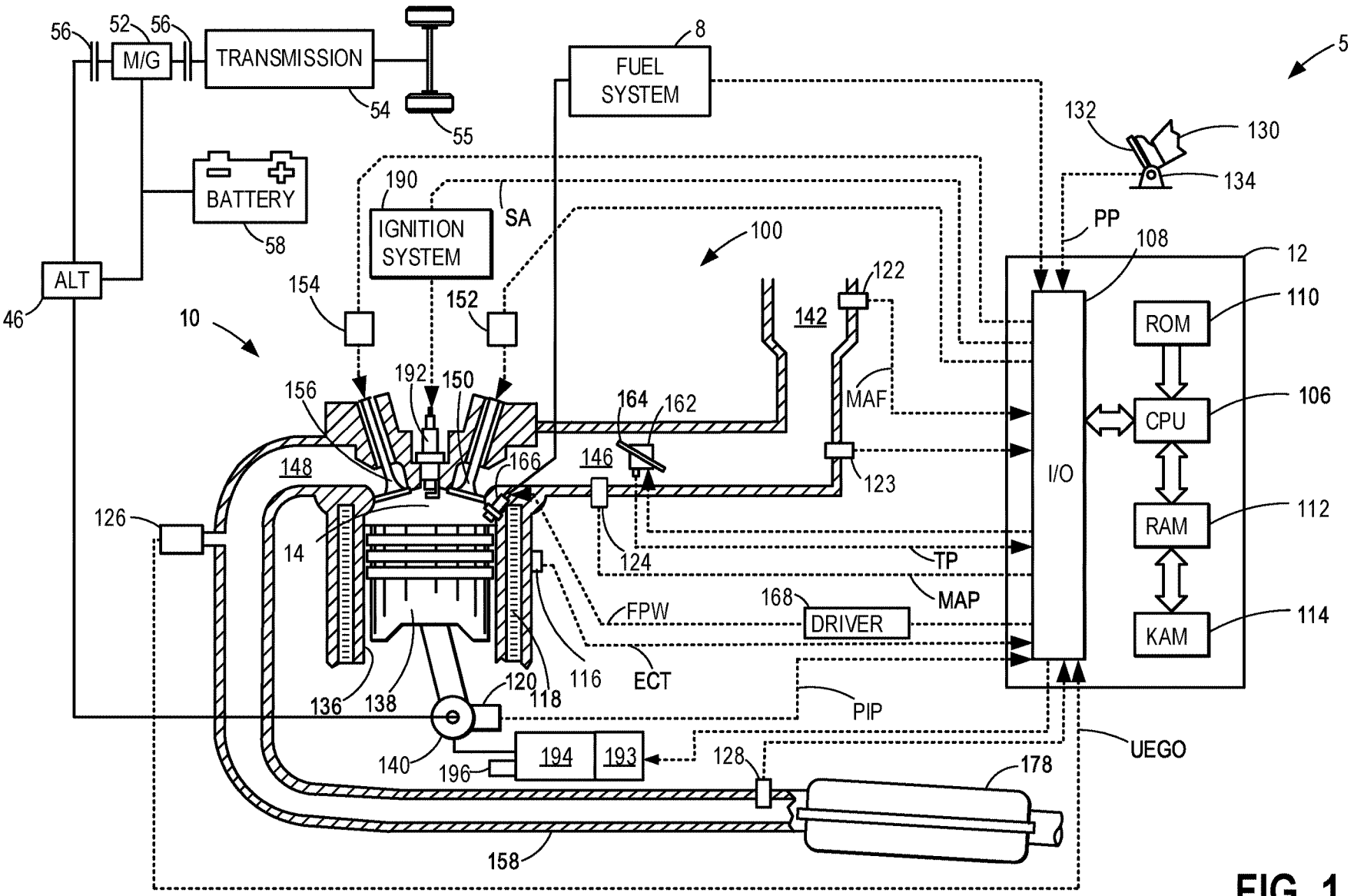
FIG. 1 shows a schematic depiction of an engine system of a vehicle.
Figure 2:
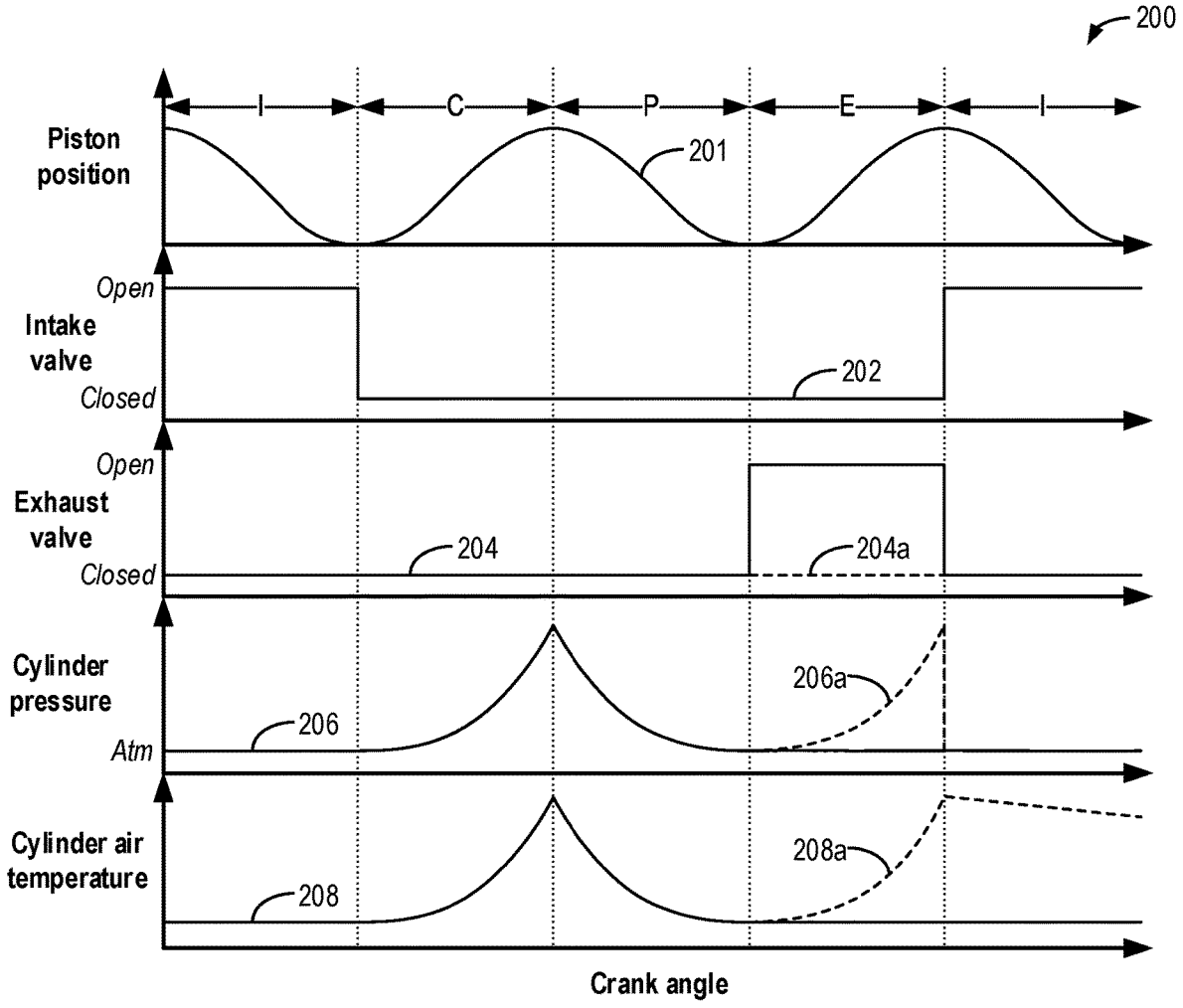
FIG. 2 shows an example graph of an air cycle in an idealized engine with and without exhaust valve deactivation.

The following description relates to systems and methods for increasing a temperature of a gas via compression heating within engine cylinders, such as the engine cylinder schematically shown in FIG. 1. The gas may include a mixture of fresh air and residual exhaust gas, also referred to herein as "air." A thermodynamic mechanism that leads to the increased temperature during the compression heating is described with respect to an air cycle of the engine cylinder, as illustrated in FIG. 2. The compression heating may be used to increase the temperature of an air charge prior to a first combustion event (also referred to as "firing" herein) of the engine and after the first combustion event, such as according to the example methods shown in FIGS. 3 and 4, respectively. An example of operating the engine with compression heating is shown with reference to FIG. 5.

FIG. 1 depicts an example of a cylinder 14 of an internal combustion engine 10, which may be included in an engine system 100 in a vehicle 5. Engine 10 may be controlled at least partially by a control system, including a controller 12, and by input from a vehicle operator 130 via an input device 132. In this example, input device 132 includes an accelerator pedal and a pedal position sensor 134 for generating a proportional pedal position signal PP. Cylinder (herein, also "combustion chamber") 14 of engine 10 may include combustion chamber walls 136 with a piston 138 positioned therein. Piston 138 may be coupled to a crankshaft 140 so that reciprocating motion of the piston is translated into rotational motion of the crankshaft. Crankshaft 140 may be coupled to at least one vehicle wheel 55 via a transmission 54, as further described below. Further, a starter motor (not shown) may be coupled to crankshaft 140 via a flywheel to enable a starting operation of engine 10.

In some examples, vehicle 5 may be a hybrid vehicle with multiple sources of torque available to one or more vehicle wheels 55. In other examples, vehicle 5 is a conventional vehicle with only an engine or an electric vehicle with only an electric machine(s). In the example shown in FIG. 1, vehicle 5 includes engine 10 and an electric machine 52. Electric machine 52 may be a motor or a motor/generator. Crankshaft 140 of engine 10 and electric machine 52 are connected via transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission.

The powertrain may be configured in various manners, including as a parallel, a series, or a series-parallel hybrid vehicle. In electric vehicle embodiments, a system battery 58 may be a traction battery that delivers electrical power to electric machine 52 to provide torque to vehicle wheels 55. In some embodiments, electric machine 52 may also be operated as a generator to provide electrical power to charge system battery 58, for example, during a braking operation. It will be appreciated that in other embodiments, including non-electric vehicle embodiments, system battery 58 may be a typical starting, lighting, ignition (SLI) battery coupled to an alternator 46.

Alternator 46 may be configured to charge system battery 58 using engine torque via crankshaft 140 during engine running. In addition, alternator 46 may power one or more electrical systems of the engine, such as one or more auxiliary systems including a heating, ventilation, and air conditioning (HVAC) system, vehicle lights, an on-board entertainment system, and other auxiliary systems based on their corresponding electrical demands. In one example, a current drawn on the alternator may continually vary based on each of an operator cabin cooling demand, a battery charging requirement, other auxiliary vehicle system demands, and motor torque. A voltage regulator may be coupled to alternator 46 in order to regulate the power output of the alternator based upon system usage requirements, including auxiliary system demands.

Cylinder 14 of engine 10 can receive intake air via an intake passage 142 and an intake manifold 146. Intake manifold 146 can communicate with other cylinders of engine 10 in addition to cylinder 14. In some examples, intake passage 142 may include one or more boosting devices coupled therein, such as a turbocharger or a supercharger, when the engine system is a boosted engine system. A throttle 162 including a throttle plate 164 may be provided in the intake passage for varying the flow rate and/or pressure of intake air provided to the engine cylinders. An exhaust manifold 148 can receive exhaust gases from cylinder 14 as well as other cylinders of engine 10.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder. Intake valve 150 may be controlled by controller 12 via an actuator 152. Similarly, exhaust valve 156 may be controlled by controller 12 via an actuator 154. The positions of intake valve 150 and exhaust valve 156 may be determined by respective valve position sensors (not shown).

During some conditions, controller 12 may vary the signals provided to actuators 152 and 154 to control the opening and closing of the respective intake and exhaust valves. The valve actuators may be of an electric valve actuation type, a cam actuation type, or a combination thereof. The intake and exhaust valve timing may be controlled concurrently, or any of a possibility of variable intake cam timing, variable exhaust cam timing, dual independent variable cam timing, or fixed cam timing may be used. Each cam actuation system may include one or more cams and may utilize one or more of cam profile switching (CPS), variable cam timing (VCT), variable valve timing (VVT), and/or variable valve lift (VVL) systems that may be operated by controller 12 to vary valve operation. For example, cylinder 14 may alternatively include an intake valve controlled via electric valve actuation and an exhaust valve controlled via cam actuation, including CPS and/or VCT. In other examples, the intake and exhaust valves may be controlled by a common valve actuator (or actuation system) or a variable valve timing actuator (or actuation system). As an example, both exhaust valve 156 and intake valve 150 may be active while operating in a combustion mode. As used herein when referring to the intake and exhaust valves, "active" or "activated" refers to a valve operating state in which the valve is opened (e.g., lifted) according to a desired valve timing, such as once per engine cycle.

In some examples, one or more of intake valve 150 and exhaust valve 156 may be deactivated during select operating modes. As an example, intake valve 150 may remain active while exhaust valve 156 is deactivated during a compression heating mode, as will be described with respect to FIGS. 2-4. In one example, intake valve 150 and/or exhaust valve 156 may be deactivated via hydraulically actuated lifters coupled to valve pushrods or via a CPS mechanism in which a cam lobe with no lift is used for deactivated valves. Still other valve deactivation mechanisms may also be used, such as for electrically actuated valves. In still other examples, a distinct actuator may control deactivation for all of the intake valves while another distinct actuator controls deactivation for all of the exhaust valves of engine 10. It will be appreciated that if the cylinder is a non-deactivatable cylinder, then the cylinder may not have any valve deactivating actuators. As used herein when referring to the intake and exhaust valves, "deactivated"

refers to a valve operating state in which the valve is maintained closed (e.g., not lifted) throughout a desired number of engine cycles.

Cylinder 14 can have a compression ratio (CR), which is a ratio of volumes when piston 138 is at bottom dead center (BDC) to top dead center (TDC). In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, engine 10 may be a variable compression ratio (VCR) engine equipped with a mechanism to alter (e.g., mechanically) the volumetric ratio between the piston TDC and BDC, allowing the compression ratio to be varied as engine operating conditions change. As a non-limiting example, the VCR engine may be configured with a mechanical piston displacement changing mechanism (e.g., an eccentric) that moves the piston closer to or further from the cylinder head, thereby changing the size of the combustion chambers. In another example, a cylinder head volume may be mechanically altered.

As shown in FIG. 1, in some examples, the CR of the engine may be varied via a VCR actuator 193 actuating a VCR mechanism 194. In some examples, the CR may be varied between a first, lower CR (wherein the ratio of the cylinder volume when the piston is at BDC to the cylinder volume when the piston is at TDC is smaller) and a second, higher CR (wherein the ratio is higher). In other examples, there may be predefined number of stepped compression ratios between the first, lower CR and the second, higher CR. In still other examples, the CR may be continuously variable between the first, lower CR and the second, higher CR (to any CR in between).

In the depicted example, VCR mechanism 194 is coupled to piston 138 such that the VCR mechanism may change the piston TDC position. For example, piston 138 may be coupled to crankshaft 140 via VCR mechanism 194, which may be a piston position changing mechanism that moves the piston closer to or further from the cylinder head, thus changing the position of the piston and thereby the size of combustion chamber 14. A position sensor 196 may be coupled to the VCR mechanism 194 and may be configured to provide feedback to controller 12 regarding the position of VCR mechanism 194 (and thereby the CR of the cylinder).

In one example, changing the position of the piston within the combustion chamber also changes the relative displacement of the piston within the cylinder. The piston position changing VCR mechanism may be coupled to a conventional cranktrain or an unconventional cranktrain. Non-limiting examples of an unconventional cranktrain to which the VCR mechanism may be coupled include variable distance head crankshafts and variable kinematic length crankshafts. In one example, crankshaft 140 may be configured as an eccentric shaft. In another example, an eccentric may be coupled to, or in the area of, a piston pin, with the eccentric changing the position of the piston within the combustion chamber. Movement of the eccentric may be controlled by oil passages in the piston rod.

It will be appreciated that still other VCR mechanisms that mechanically alter the compression ratio may be used. For example, the CR of the engine may be varied via a VCR mechanism that changes a cylinder head volume (that is, the clearance volume in the cylinder head). In another example, the VCR mechanism may include a hydraulic pressure-reactive, air pressure-reactive, or mechanically reactive piston. Further still, the VCR mechanism may include a multi-link mechanism, a bent rod mechanism, or other VCR mechanizations.

It will be appreciated that as used herein, the VCR engine may be configured to adjust the CR of the engine via mechanical adjustments that vary a piston position or a cylinder head volume. As such, VCR mechanisms do not include CR adjustments achieved via adjustments to a valve or cam timing.

Each cylinder of engine 10 may include a spark plug 192 for initiating combustion. An ignition system 190 can provide an ignition spark to combustion chamber 14 via spark plug 192 in response to a spark advance signal SA from controller 12, under select operating modes. A timing of signal SA may be adjusted based on engine operating conditions and driver torque demand. For example, spark may be provided at maximum brake torque (MBT) timing to maximize engine power and efficiency. Controller 12 may input engine operating conditions, including engine speed, engine load, and exhaust gas AFR, into a look-up table and output the corresponding MBT timing for the input engine operating conditions. In other examples, spark may be retarded from MBT, such as to expedite catalyst warm-up during engine start or to reduce an occurrence of engine knock.

In some examples, engine 10 may be operated in a spark ignition (SI) mode and a spark-controlled compression ignition (SPCCI) mode, with the ignition mode selected based on operating conditions. For example, the SPCCI mode may be selected at lower engine speeds and loads and while the engine is warmer, and the SI mode may be selected at higher engine speeds and loads and while the engine is cooler. In other examples, engine 10 may be operated in the SI mode only. In the SI mode, the ignition spark from spark plug 192 initiates flame-propagation combustion, and a mixture of air and fuel within cylinder 14 is kept at or near an air-fuel ratio (AFR) of stoichiometry. In the SPCCI mode, the ignition spark from spark plug 192 ignites a rich air-fuel mixture that is localized around spark plug 192. The localized spark-ignited combustion creates a compression effect on a remaining lean air-fuel mixture within cylinder 14, such as by further increasing a temperature and pressure within cylinder 14. The compression effect simultaneously ignites the remaining (lean) air-fuel mixture within cylinder 14. Thereby, the ignition spark during the SPCCI mode is used to control a timing of a compression ignition event of a higher pressure, higher temperature, and leaner AFR mixture than used in the SI mode. Operating in the SPCCI mode may reduce cooling loses, reduce throttling loses, and increase fuel economy. Methods that increase air charge temperature, such as the example methods that will be described with respect to FIGS. 3 and 4, may facilitate operation in the SPCCI mode.

In some examples, each cylinder of engine 10 may be configured with one or more fuel injectors for providing fuel thereto. As a non-limiting example, cylinder 14 is shown including a fuel injector 166. Fuel injector 166 may be configured to deliver fuel received from a fuel system 8. Fuel system 8 may include one or more fuel tanks, fuel pumps, and fuel rails. Fuel injector 166 is shown coupled directly to cylinder 14 for injecting fuel directly therein in proportion to a pulse width of a signal FPW received from controller 12 via an electronic driver 168. In this manner, fuel injector 166 provides what is known as direct injection (hereafter also referred to as "DI") of fuel into cylinder 14.

While FIG. 1 shows fuel injector 166 positioned to one side of cylinder 14, fuel injector 166 may alternatively be located overhead of the piston, such as near the position of spark plug 192. Such a position may increase mixing and combustion when operating the engine with an alcohol-based fuel due to the lower volatility of some alcohol-based fuels. Alternatively, the injector may be located overhead and near the intake valve to increase mixing. Fuel may be delivered to fuel injector 166 from a fuel tank of fuel system 8 via a high pressure fuel pump and a fuel rail. Further, the fuel tank may have a pressure transducer providing a signal to controller 12.

In an alternate example, fuel injector 166 may be arranged in an intake passage rather than coupled directly to cylinder 14 in a configuration that provides what is known as port injection of fuel (hereafter also referred to as "PFI") into an intake port upstream of cylinder 14. In yet other examples, cylinder 14 may include multiple injectors, which may be configured as direct fuel injectors, port fuel injectors, or a combination thereof. As such, it should be appreciated that the fuel systems described herein should not be limited by the particular fuel injector configurations described herein by way of example.

Fuel injector 166 may be configured to receive different fuels from fuel system 8 in varying relative amounts as a fuel mixture and further configured to inject this fuel mixture directly into cylinder. Further, fuel may be delivered to cylinder 14 during different strokes of a single cycle of the cylinder. For example, directly injected fuel may be delivered at least partially during a previous exhaust stroke, during an intake stroke, and/or during a compression stroke. As such, for a single combustion event, one or multiple injections of fuel may be performed per cycle. The multiple injections may be performed during the compression stroke, intake stroke, or any appropriate combination thereof in what is referred to as split fuel injection. In particular, split injection may be performed during the SPCCI mode. For example, a first fuel injection during the intake stroke may create a uniform, lean air-fuel mixture, and a second injection during the compression stroke may create a localized rich mixture around the spark plug 192 for ignition.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof, etc. One example of fuels with different heats of vaporization includes gasoline as a first fuel type with a lower heat of vaporization and ethanol as a second fuel type with a greater heat of vaporization. In another example, the engine may use gasoline as a first fuel type and an alcohol-containing fuel blend, such as E85 (which is approximately 85% ethanol and 15% gasoline) or M85 (which is approximately 85% methanol and 15% gasoline), as a second fuel type. Other feasible substances include water, methanol, a mixture of alcohol and water, a mixture of water and methanol, a mixture of alcohols, etc. In still another example, both fuels may be alcohol blends with varying alcohol compositions, wherein the first fuel type may be a gasoline alcohol blend with a lower concentration of alcohol, such as E10 (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities, such as a difference in temperature, viscosity, octane number, etc. Moreover, fuel characteristics of one or both fuel tanks may vary frequently, for example, due to day to day variations in tank refilling.

An exhaust gas sensor 126 is shown coupled to exhaust manifold 148 upstream of an emission control device 178, coupled within an exhaust passage 158. Exhaust gas sensor 126 may be selected from among various suitable sensors for providing an indication of an exhaust gas AFR, such as a linear oxygen sensor or UEGO (universal or wide-range exhaust gas oxygen), a two-state oxygen sensor or EGO, a HEGO (heated EGO), a NOx, a HC, or a CO sensor, for example. In the example of FIG. 1, exhaust gas sensor 126 is a UEGO sensor configured to provide an output, such as a voltage signal, that is proportional to an amount of oxygen present in the exhaust gas. Emission control device 178 may be a three-way catalyst, a NOx trap, various other emission control devices, or combinations thereof. In the example of FIG. 1, emission control device 178 is a three-way catalyst configured to reduce NOx and oxidize CO and unburnt hydrocarbons.

Controller 12 is shown in FIG. 1 as a microcomputer, including a microprocessor unit 106, input/output ports 108, an electronic storage medium for executable programs (e.g., executable instructions) and calibration values shown as non-transitory read-only memory chip 110 in this particular example, random access memory 112, keep alive memory 114, and a data bus. Controller 12 may receive various signals from sensors coupled to engine 10, including signals previously discussed and additionally including a measurement of inducted mass air flow (MAF) from a mass air flow sensor 122; an engine coolant temperature (ECT) from an engine coolant temperature sensor 116 coupled to a cooling sleeve 118; an ambient temperature from a temperature sensor 123 coupled to intake passage 142; an exhaust gas temperature from a temperature sensor 128 coupled to exhaust passage 158; a profile ignition pickup signal (PIP) from a Hall effect sensor 120 (or other type) coupled to crankshaft 140; throttle position (TP) from the throttle position sensor; signal UEGO from exhaust gas sensor 126, which may be used by controller 12 to determine the (air-fuel ratio) AFR of the exhaust gas; and an absolute manifold pressure signal (MAP) from a MAP sensor 124. An engine speed signal, RPM, may be generated by controller 12 from signal PIP. The manifold pressure signal MAP from MAP sensor 124 may be used to provide an indication of vacuum or pressure in the intake manifold. Controller 12 may infer an engine temperature based on the engine coolant temperature. Additional sensors, such as various temperature, pressure, and humidity sensors, may be coupled throughout vehicle 5.

Controller 12 receives signals from the various sensors of FIG. 1 and employs the various actuators of FIG. 1 to adjust engine operation based on the received signals and instructions stored on a memory of the controller. For example, based on signal ECT from engine coolant temperature sensor 116, the controller may deactivate exhaust valve 156 (e.g., via exhaust valve actuator 154) and disable fuel injector 166 to operate cylinder 14 in the compression heating mode, such as according to the example methods of FIGS. 3 and 4.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

As mentioned above, one or more cylinders may be operated in a compression heating mode. The compression heating mode uses the compression and rapid expansion of air to increase a thermal energy of the air. Turning now to FIG. 2, an example graph 200 of an air cycle in an unfueled cylinder of an idealized four-stroke engine is shown. Piston position is shown in plot 201, intake valve opening is shown in plot 202, exhaust valve opening is shown in plot 204, cylinder pressure is shown in plot 206, and cylinder air temperature is shown in plot 208. For all of the above, the horizontal axis represents crank angle, with crank angle increasing along the horizontal axis from left to right. The vertical axis represents each labeled parameter. For plot 201, piston position increases along the vertical axis from bottom to top. For plots 202 and 204, the vertical axis represents whether the intake valve and exhaust valve, respectively, are "open" or "closed." In this example, "open" refers to partially or fully open (e.g., not closed), and closed refers to fully closed (e.g., not lifted). For plot 206, cylinder pressure increases along the vertical axis from bottom to top and is shown with respect to atmospheric pressure ("atm"). For plot 208, the cylinder air temperature (e.g., the temperature of air within the cylinder, which may be a mixture of fresh air and residual exhaust gas) increases along the vertical axis from bottom to top. Engine strokes are labeled as "I" for intake, "C" for compression, "P" for power, and "E" for exhaust. Differences while operating in the compression heating mode will be described with reference to dashed segments 204*a*, 206*a*, and 208*a*.

During each intake stroke, the intake valve is open (plot 202) and the exhaust valve is closed (plot 204). With the cylinder coupled to the atmosphere through the open intake valve, the cylinder pressure is equal to atmospheric pressure (plot 206), and the cylinder air temperature is low (plot 208). During the compression stroke, both the intake valve (plot 202) and the exhaust valve (plot 204) are closed, sealing the cylinder. As the piston rises within the cylinder during the compression stroke (plot 201), the volume of the cylinder decreases. The cylinder pressure (plot 206) increases as the volume of the sealed cylinder decreases and the air (e.g., gas) within the cylinder is compressed (e.g., pressurized). Furthermore, a maximum cylinder pressure achieved during the compression stroke increases as a compression ratio of the cylinder increases. The compression energy increases the temperature of the air within the cylinder (plot 208). A maximum cylinder air temperature achieved during the compression stroke also increases as the compression ratio of the cylinder increases.

As the piston moves back down during the power stroke (plot 201), the cylinder volume expands, decreasing the cylinder pressure (plot 206) back to atmospheric pressure. The intake valve (plot 202) and the exhaust valve (plot 204) remain closed during the power stroke. For example, in the absence of combustion and with the intake and exhaust valves closed, the compressed air acts as an air spring helping to push the piston back to its starting position. As the cylinder volume expands, heat energy from the cylinder air is extracted by the piston into work, resulting in the cylinder air temperature decreasing (plot 208). To the extent that the example shown in FIG. 2 is an adiabatic (no heat loss) process, the cylinder pressure (plot 206) and cylinder air temperature (plot 208) at the end of the power stroke match those from the beginning of the compression stroke (e.g., the pressure and temperature are largely symmetric during the compression and power stroke).

During the exhaust stroke, the rise of the piston (plot 201) again decreases the cylinder volume. However, the exhaust valve is open (plot 204), forcing the air out of the cylinder (e.g., into an exhaust manifold) instead of compressing it. As a result, the cylinder pressure remains at atmospheric pressure (plot 206). In the idealized example of graph 200, the cylinder air is not substantially heated (plot 208), and an amount of energy imparted to the air from intake stroke to intake stroke is equal since energy is conserved (e.g., the compression is isentropic). For example, a compression energy may be equal and opposite of an expansion energy.

However, if the exhaust valve is instead held closed (e.g., deactivated) during the exhaust stroke, as shown in dashed segment 204*a*, the cylinder pressure (plot 206*a*) increases as the air within the cylinder is compressed by the rising piston, just as during the compression stroke. Also as during the compression stroke, the cylinder air temperature (plot 208*a*) increases as it is compressed. When the cylinder pressure is maximal, the intake valve is opened during the intake stroke (plot 202). As a result, the compressed cylinder air is rapidly expanded from being pressurized to being at atmospheric pressure. For example, at least a portion of the compressed air may be discharged back into an intake manifold of the engine through the open intake valve and via an intake runner. While the cylinder pressure drops rapidly (plot 206*a*), the air temperature does not (plot 208*a*). Instead of the compression energy being extracted by the piston into work, as during the power stroke, the compression energy remains as heat energy of the air that had been compressed within the cylinder prior to the intake valve opening. Thus, the intake runner is filled with high temperature intake air (e.g., the air discharged back into the intake manifold) in addition to any heated air that remains within the cylinder. The completion of the four-stroke air cycle while operating in the compression heating mode may be referred to herein as a "compression heating cycle." The heated intake air may then be drawn back into the cylinder as the piston moves down during the intake stroke (plot 201), resulting in an increased cylinder air temperature (plot 208*a*) compared to when the exhaust valve is not deactivated (plot 208). The temperature of the hot air may decrease as heat is transferred to walls of the intake manifold and combustion chamber walls (plot 208*a*). In this way, by deactivating exhaust valves and maintaining intake valve activity, energy from compression can be used to increase a temperature of an air charge prior to a first firing of a cylinder or while fueling is disabled after the first firing, as further described below.

Figure 3:
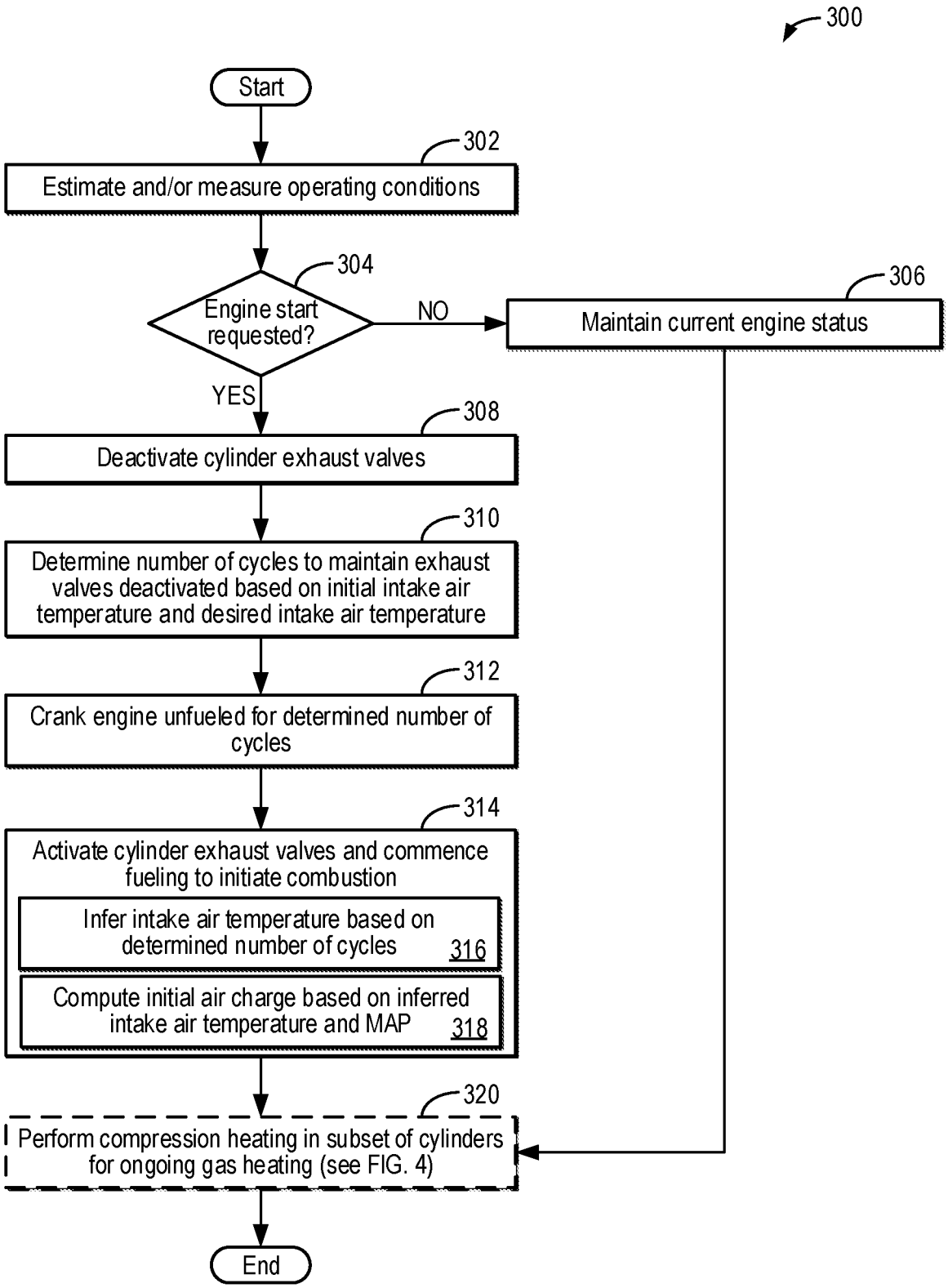
FIG. 3 is a high-level flowchart of an example method for compression heating of air in response to an engine start request.

Next, FIG. 3 shows an example method 300 for performing compression heating of air during initial operation of an engine (e.g., engine 10 shown in FIG. 1). For example, the engine cylinders may be operated in a compression heating mode for one or more compression heating cycles, such as described above with reference to FIG. 2, to increase the in-cylinder and intake air temperatures, and therefore air charge temperature, prior to a first firing event when an engine start is requested. Instructions for carrying out method 300 and the rest of the methods included herein may be executed by a controller (e.g., controller 12 of FIG. 1) based on instructions stored on a memory of the controller and in conjunction with signals received from sensors of the engine system, such as the sensors described above with reference to FIG. 1 (e.g., ambient temperature sensor 123, MAP sensor 124, and engine coolant temperature sensor 116 of FIG. 1). The controller may employ engine actuators of the engine system (e.g., electric machine 52 and exhaust valve actuator 154 of FIG. 1) to adjust engine operation according to the methods described below.

Method 300 begins at 302 and includes estimating and/or measuring operating conditions. Operating conditions may include, for example, ambient temperature, manifold pressure, throttle position (e.g., from signal TP output by a throttle position sensor), accelerator pedal position (e.g., signal PP output by a pedal position sensor), engine coolant temperature, cylinder compression ratio (e.g., from position sensor 196 of FIG. 1), a state of the engine, and an ignition state of the vehicle. The state of the engine may refer to whether the engine is on (e.g., operating at a non-zero speed, with combustion occurring within engine cylinders) or off (e.g., at rest, without combustion occurring in the engine cylinders). The ignition state of the vehicle may refer to a position of an ignition switch. As an example, the ignition switch may be in an "off" position, indicating that the vehicle is off (e.g., powered down, with a vehicle speed of zero), or in an "on" position, in which the vehicle is on (e.g., with power supplied to vehicle systems). The state of the engine and the state of the vehicle may be different. For example, the vehicle may be on and operating in an electric-only mode, in which an electric machine supplies torque to propel the vehicle and the engine is off and does not supply torque to propel the vehicle. As another example, the vehicle may be on and the engine may be shut off during an idle-stop, in which the engine is shut off while the vehicle remains on. In one example, the vehicle may be at rest when the idle-stop is performed. In another example, the vehicle may be in motion (e.g., coasting) when the idle-stop is performed. Optionally, when the engine includes an electrically-powered boosting device (e.g., an electric supercharger), the electrically-powered boosting device may be engaged to increase the cylinder mass, thus increasing cylinder heat.

At 304, it is determined if an engine start is requested. For example, an engine start may be requested by a vehicle operator switching the ignition switch to an "on" position, such as by turning the ignition key, depressing an ignition button, or requesting an engine start from a remote device (such as a key-fob, smartphone, a tablet, etc.). In another example, an engine start may be requested by the controller to transition the vehicle from the electric-only mode to an engine mode in which combustion occurs in the engine and the vehicle is propelled at least partially by engine-derived torque. For example, the vehicle may be transitioned to the engine mode when a state of charge (SOC) of a system battery (e.g., system battery 58 of FIG. 1) drops below a threshold SOC. The threshold SOC may be a positive, non-zero battery SOC level below which the system battery may not be able to support or execute additional vehicle functions while propelling the vehicle via torque derived from the electric machine (e.g., 30%). As another example, the vehicle may be transitioned to the engine mode if torque demand rises above a threshold torque. The threshold torque may be a positive, non-zero amount of torque that cannot be met or sustained by the electric machine alone, for example. In still another example, the engine start may be requested by the vehicle controller to exit an idle-stop.

If an engine start is not requested, method 300 proceeds to 306 and includes maintaining the current engine status. For example, if the engine is on, the engine will remain on. If the engine is off, the engine will remain off. The method may optionally proceed to 320, in which a routine for ongoing gas heating may be performed, as will be described below.

If an engine start is requested, method 300 proceeds to 308 and includes deactivating cylinder exhaust valves. For example, the exhaust valve(s) coupled each cylinder of the engine may be maintained closed via a cam profile switching mechanism in which a cam with no lift is used or by actuating a valve deactivator. As another example, when the exhaust valves are of the electric valve actuation type, the controller may not provide signals to open the exhaust valves to an exhaust valve actuator. While the exhaust valves are deactivated, the cylinder intake valves remain active such that the intake valves may open during each intake stroke. Thus, at 308, the cylinders of the engine may be transitioned to operating in the compression heating mode. In some examples, such as when hardware restrictions of the engine enable deactivation of only a subset of the engine cylinders, the exhaust valves of the subset of the engine cylinders may be deactivated while the remaining (undeactivatable) exhaust valves may remain active.

At 310, method 300 includes determining a number of cycles to maintain the exhaust valves deactivated based on an initial intake air temperature and a desired intake air (or air charge) temperature. For example, an isentropic compression model that takes into account the initial intake air temperature and a compression ratio of the engine may be used to determine the number of cycles (e.g., compression heating cycles) that will result in the intake air temperature reaching or exceeding the desired intake air temperature (or the air charge temperature reaching or exceeding the desired air charge temperature). The initial intake air temperature may be equal to the ambient temperature, for example, when no prior compression heating cycles have been performed. The desired intake air temperature may be a fixed, calibratable temperature value, such as a temperature value in a range from 200 to 500° C. Each time the compression heating cycle is performed (e.g., once in each cylinder per engine cycle), the temperature of the intake air increases as compressed, heated gas is discharged from the cylinder back into the intake manifold, as described with respect to FIG. 2. Thus, two compression heating cycles will increase the intake air temperature more than one, three compression heating cycles will increase the temperature more than two, etc. Furthermore, the higher the compression ratio of the engine, the greater the temperature increase over a single compression heating cycle. For example, a compression ratio of 10:1 will result in a greater intake air temperature than a compression ratio of 9:1 for the same starting (e.g., ambient) temperature. Therefore, in some examples, when the engine is a variable compression ratio engine, the compression ratio may be increased to more quickly raise the temperature of the intake air (e.g., over a smaller number of engine cycles) and/or raise the temperature of the intake air to a higher temperature. For example, the controller may actuate a VCR mechanism (e.g., VCR mechanism 194 of FIG. 1) via a VCR actuator (e.g., a VCR actuator 193 of FIG. 1) to increase the compression ratio of the engine.

As one example, the controller may estimate the intake air temperature after one compression heating cycle ($T_2$) from the initial intake air temperature ($T_1$), an initial in-cylinder pressure ($P_1$), a final cylinder pressure ($P_2$), and a ratio of specific heats ($\gamma$) using the following isentropic compression model:

$$(T_2/T_1) = (P_2/P_1)^{[1-\frac{1}{\gamma}]}.$$

In some examples, a ratio of pressures ($P_2/P_1$) may be inferred from the compression ratio. The temperature value $T_2$ may then be used as the initial intake air temperature value $T_1$ for the next compression heating cycle.

At 312, method 300 includes cranking the engine unfueled for the determined number of cycles. The engine may be cranked with an electric motor, such as a starter motor or an electric machine (e.g., electric machine 52 of FIG. 1), at a high speed, such as a speed in a range from 600-2000 RPM. Because heat loss due to heat transfer to engine components (e.g., intake manifold walls, cylinder walls, etc.) is a function of time, cranking at the high speed reduces the heat loss. For example, increasing the cranking speed from 200 RPM to 1000 RPM may reduce the heat loss by a factor of 5. By reducing the heat loss during the cranking, the compression heating will have a greater effect on the air temperature. An amount of energy supplied to the electric motor may be higher during each compression heating cycle compared with a non-compression heating crank cycle at the same cranking speed. For example, with the exhaust valves deactivated and the intake valves active, the additional compression during the exhaust stroke (due to the deactivated exhaust valves) and a lack of shaft work in the intake stroke (due to the active intake valves) increases an amount of electric motor torque needed to maintain the cranking speed during the compression heating cycle. Furthermore, spark may not be provided by a spark plug coupled to each cylinder (e.g., spark plug 192 of FIG. 1), as combustion is not performed and sparking may add an insignificant amount of energy to the air.

At 314, method 300 includes activating the cylinder exhaust valves and commencing fueling to initiate combustion. That is, after the engine is cranked unfueled for the determined number of cycles with the exhaust valves deactivated, the engine may continue to be cranked while the exhaust valves are activated and fuel is injected via fuel injectors (e.g., fuel injector 166 of FIG. 1). For example, the exhaust valves may be activated via a cam profile switching mechanism in which a cam with lift is used or by actuating (e.g., deactivating) a valve deactivator. Thus, at 314, method 300 includes transitioning the cylinders from operating in the compression heating mode to operating in a combustion mode.

To determine an amount of fuel to inject while transitioning to operating in the combustion mode, method 300 further includes inferring the intake air temperature based on the determined number of cycles, as indicated at 316, and computing an initial air charge (e.g., a mass of air within the cylinder) based on MAP and the inferred intake air temperature, as indicated at 318. The intake air temperature may be determined using the isentropic compression model described above at 310. Then, the controller may input MAP at intake valve closing and the inferred intake air temperature into a look-up table, map, or function and output the initial air charge. In some examples, the initial air charge may be further determined based on a volume of the cylinder at intake valve closing, which may also be input into the look-up table, function, or map. The volume of the cylinder may be a known volume quantity that is stored in a non-transitory memory of the controller. As an example, the controller determine the initial air charge by solving $PV=mRT$ for a mass (m) of the air charge, where P is pressure in the cylinder at intake valve closing (e.g., MAP at intake valve closing), V is the volume trapped by the cylinder at intake valve closing, R is the ideal gas constant, and T is the inferred intake air temperature (e.g., near the intake valve). The initial air charge may then be used to determine the amount of fuel to inject for an initial firing event. For example, the controller may determine a control signal to send to the fuel injector actuator, such as a pulse-width of the signal, based on the initial air charge and a desired air-fuel ratio (AFR). The controller may determine the pulse-width through a determination that directly takes into account the air charge and the desired AFR, such as by increasing the pulse-width with increasing air charge. The controller may alternatively determine the pulse-width via a look-up table by inputting the initial air charge and the AFR and the outputting the pulse-width. Further, spark may be provided to initiate combustion at a timing determined based on operating conditions, such as described with respect to FIG. 1. For example, spark may be provided at or near MBT timing to maximize an amount of combustion torque produced by each firing event. As another example, spark may be retarded from MBT timing to aid heating of an exhaust catalyst (e.g., emission control device 178 of FIG. 1). Due to the heating, the density of the intake air is decreased compared to when the intake air is not heated. As a result, a smaller mass of air is inducted into the cylinder during the intake stroke after the compression heating cycle. For example, the initial air charge may be lower (e.g., for a same throttle position) than when the intake air temperature is lower. Therefore, the amount of fuel injected may be lower than when the intake air temperature is lower, resulting in a smaller amount of combustion torque during an initial firing of the engine. As the combustion torque increases, the electric motor torque may be decreased until the electric motor torque is reduced to zero and the engine is spun via combustion torque alone. In some examples, as the engine is transitioned to operating via combustion torque and without electric motor torque, the engine speed may be decreased from the high cranking speed to a lower engine idle speed.

In some examples, every engine cylinder is transitioned to operating in the combustion mode after the determined number of cycles. In other examples, one or more cylinders (e.g., a subset of the engine cylinders) may continue to operate in the compression heating mode, unfueled and with corresponding exhaust valves deactivated, while the remaining cylinders are operated in the combustion mode. In particular, continued compression heating may be performed while the engine temperature is lower (e.g., lower than a threshold temperature, as described further herein) or while a desired intake air temperature is higher (e.g., for SPCCI). Therefore, at 320, method 300 optionally includes performing the compression heating in a subset of cylinders for gas heating, as will be described with respect to FIG. 4. As an example, each cylinder in the subset of cylinders may be alternately fired and unfired (e.g., alternated between operating in the combustion mode and operating in the compression heating mode each engine cycle), with the corresponding exhaust valve deactivated and the cylinder unfueled during the unfired cycle, until the engine reaches a desired temperature. Following 320, method 300 ends.

By deactivating the exhaust valves and spinning the engine unfueled during an engine start, the temperature of the intake air and in-cylinder air (and thus the temperature of the initial air charge) may be increased. Upon fuel injection, fuel vaporization may be increased, and the air-fuel mixture may have increased uniformity. As a result, fuel economy may be increased and vehicle emissions decreased compared to when the initial air charge is not heated prior to the first combustion event. Furthermore, the decreased intake air density (due to the increased temperature) and resulting decreased air charge during the initial firing allows the combustion torque of the engine to be gradually increased, which may provide a smoother feel for increased vehicle operator satisfaction.

Figure 4:
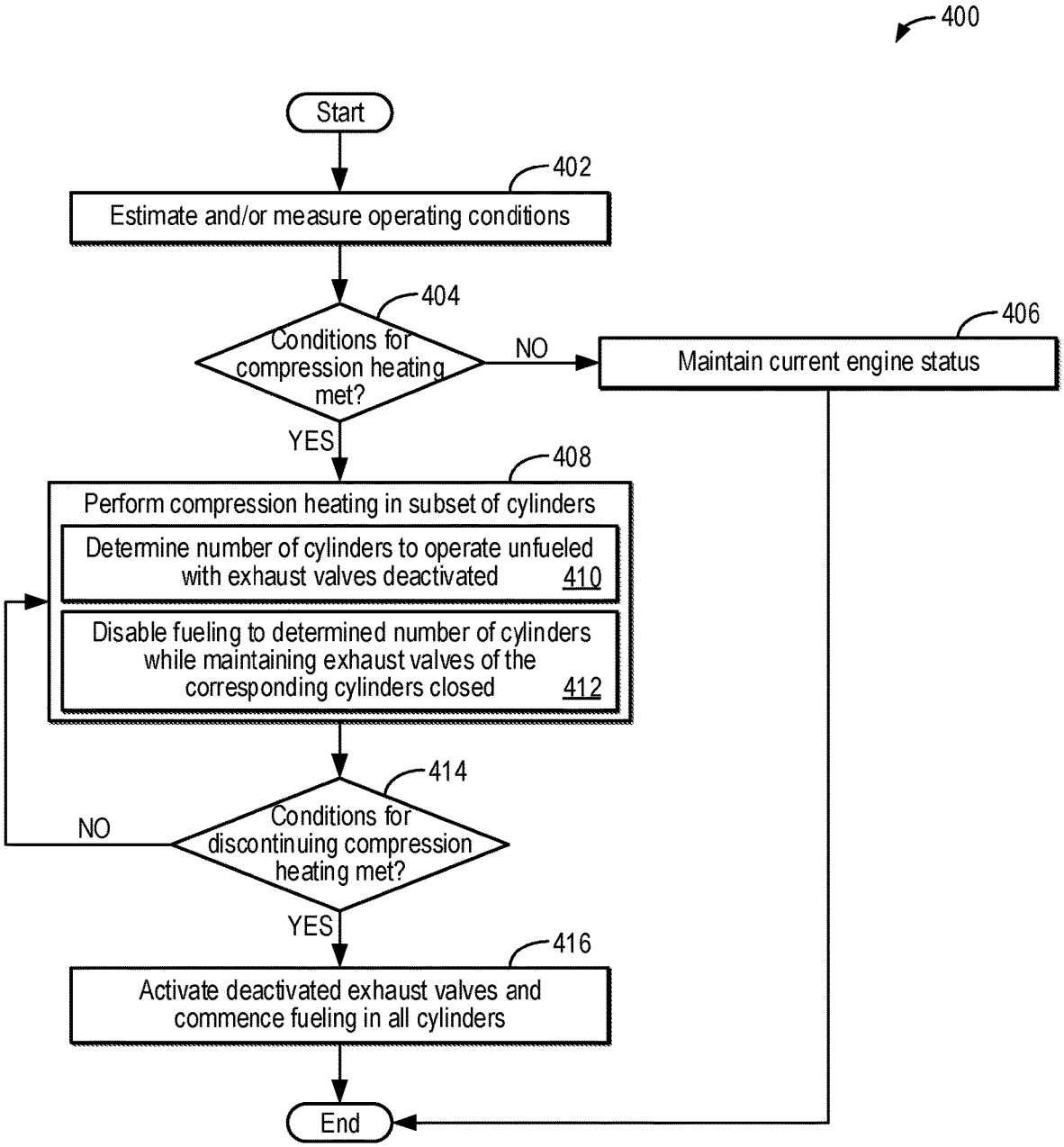
FIG. 4 is a flowchart of an example method for compression heating of air after an initial firing of an engine.

Next, FIG. 4 shows an example method 400 for compression heating of gas after an initial firing of an engine (e.g., engine 10 shown in FIG. 1). For example, one or more engine cylinders may be operated in a compression heating mode to increase a temperature of the gas, which includes a mixture of fresh air and residual exhaust gas that is discharged to an intake system and a mixture of fresh air and residual exhaust gas that remains within the one or more cylinders, while remaining engine cylinders are operated in a combustion mode to produce combustion torque. By increasing the gas temperature, fuel vaporization may be increased, resulting in increased fuel economy and decreased emissions, which may be particularly beneficial when the engine is not warmed up. Furthermore, compression heating may be used to aid operation in a SPCCI mode in which higher in-cylinder temperatures (compared with operating in a SI mode) may aid compression ignition. Method 400 may be performed as a part of method 300 of FIG. 3, such as at 320. Alternatively, method 400 may be performed responsive to any request for compression heating while the engine is on.

Method 400 begins at 402 and includes estimating and/or measuring operating conditions. Operating conditions may include engine speed, engine load, throttle position (e.g., from signal TP output by a throttle position sensor), accelerator pedal position (e.g., signal PP output by a pedal position sensor), engine temperature, catalyst temperature (e.g., as estimated from exhaust temperature sensor 128 of FIG. 1), ambient temperature (e.g., as measured by an ambient temperature sensor, such as temperature sensor 123 of FIG. 1), and compression ratio (e.g., from position sensor 196 of FIG. 1), for example. Engine speed may be determined based on a signal PIP output by a Hall effect sensor (e.g., Hall effect sensor 120 of FIG. 1), engine load may be determined based on a measurement of MAF from a MAF sensor (e.g., MAF sensor 122 of FIG. 1), and engine temperature may be inferred from a measurement of engine coolant temperature by an engine coolant temperature sensor (e.g., engine coolant temperature sensor 116 of FIG. 1), for example.

At 404, it is determined if conditions for compression heating are met. As one example, the conditions for compression heating may be met when the engine temperature is less than a threshold temperature. The threshold temperature may correspond to a non-zero, positive temperature value above which the engine is considered to be warm and at a steady state operating temperature (e.g., a temperature value within a range from 195-220° F.). As another example, conditions for compression heating may additionally or alternatively include an indication that operation in the SPCCI mode is desired, such as when the engine speed is in a low to mid-range. As another example, the conditions for compression heating may be met when fuels with lower volatility are used (e.g., fuels with high percentages of ethanol). Any or all of the conditions for compression heating may be confirmed for compression heating to be initiated.

If the conditions for compression heating are not met, method 400 proceeds to 406 and includes maintaining the current engine status. For example, if the engine is operating with all of the cylinders active (e.g., fuel is supplied to every cylinder, with every cylinder operating in the combustion mode), then the engine will continue operating with all of the cylinders active. If the engine is operating in a variable displacement engine mode, in which a subset of the cylinders produce torque, then the engine will continue operating in the variable displacement engine mode. Cylinder fueling will not be disabled for the purpose of air heating (e.g., for operation in the compression heating mode), and spark will continue to be provided to initiate combustion in both of the SI mode and the SPCCI mode. Following 406, method 400 ends.

If the conditions for compression heating are met at 404, method 400 proceeds to 408 and includes performing compression heating in a subset of engine cylinders. Performing compression heating in the subset of engine cylinders includes determining a number of cylinders to operate unfueled with exhaust valves deactivated (e.g., in the compression heating mode), as indicated at 410. The number of cylinders may be determined based on operating conditions, such as measured at 402. For example, a greater number of cylinders may be operated unfueled with exhaust valves deactivated as the torque demand decreases and/or as a difference between the engine temperature and the threshold temperature increases. Conversely, a smaller number of cylinders may be operated unfueled with exhaust valves deactivated as the torque demand increases and/or the difference between the engine temperature and the threshold temperature decreases. Further, the number of cylinders may be restricted in order to mitigate engine noise, vibration, and harshness (NVH) depending on a configuration of the engine (e.g., a layout and a total number of cylinders). The controller may determine the number of cylinders to operate unfueled and with exhaust valves deactivated by inputting the operating conditions, such as one or more of the torque demand and the engine temperature, into one or more look-up tables, maps, or algorithms and outputting the number of cylinders to operate unfueled with the exhaust valves deactivated for the given conditions. In still other examples, the controller may determine a desired induction ratio (an actual total number of cylinder firing events divided by an actual total number of cylinder compression strokes) based at least on torque demand. The controller may also select a cylinder pattern for the determined number of cylinders or induction ratio. As an example, the pattern for an induction ratio of 0.5 may include every other cylinder being fired (wherein combustion is carried out within the cylinder, with intake and exhaust valves opening and closing during a cycle of the cylinder) or unfired (wherein fueling is disabled and the corresponding exhaust valves are deactivated while the intake valves remain active). Further, the same pattern may be applied for each consecutive engine cycle such that the same cylinders are unfired on consecutive engine cycles while the remaining cylinders are fired on each of the engine cycles. In other examples, different cylinders may be unfired on each engine cycle such that the firing and unfiring is cycled or distributed uniformly amongst the engine cylinders. The cylinder pattern may be selected based on hardware restrictions or in order to mitigate engine NVH, for example.

Performing compression heating in the subset of cylinders further includes disabling fuel injection to the determined number of cylinders, as indicated at 412. For example, the fuel injection to the determined number of cylinders may be disabled, and the corresponding exhaust valves deactivated, using the selected cylinder pattern. Each corresponding exhaust valve may be deactivated and reactivated via an actuator (e.g., exhaust valve actuator 154 of FIG. 1). Using a four-cylinder engine as an example, when the determined number of cylinders is two or the induction ratio is 0.5, the fuel injection to a first set of two cylinders may be disabled and the exhaust valves of the first set of two cylinders deactivated during a first engine cycle while combustion continues in a second set of two cylinders. Then, the fuel injection to the second set of two cylinders may be disabled and the exhaust valves of the second set of two cylinders deactivated during a second engine cycle while the first set of two cylinders are fueled and their exhaust valves activated. Then, the fuel injection to the first set of two cylinders may again be disabled and their exhaust valves deactivated during a third engine cycle, etc. While fueling is disabled, spark may also be disabled in the corresponding cylinders, as combustion does not occur in the unfueled cylinders. Furthermore, while the determined number of cylinders are operated in the compression heating mode, engine operating parameters may be adjusted in order to maintain the engine torque demand with the remaining cylinders operating in the combustion mode. For example, one or more of airflow, spark timing, and cylinder valve timing may be adjusted in order to maintain the engine torque demand and minimize torque disturbances. In other examples, electrical assistance may be provided to compensate for the reduced combustion torque. In such an example, the demanded engine torque may be provided by a combination of combustion torque and electric motor torque (e.g., from an electric machine, such as electric machine 52 of FIG. 1). In this way, each cylinder may alternately be fired and unfired to distribute the compression heating uniformly throughout the engine.

At 414, it is determined if conditions for discontinuing the compression heating are met. As one example, conditions for discontinuing the compression heating may be met when the engine temperature is greater than the threshold temperature, as defined above at 404. As another example, conditions for discontinuing the compression heating may additionally or alternatively include an indication that operation in the SI mode is desired, such as when the engine is operated in a high speed range. As still another example, conditions for discontinuing the compression heating may include torque demand surpassing a threshold torque demand, the threshold torque demand corresponding to a torque demand that cannot be met with the reduced engine air charge resulting from the compression heating. Any or all of the conditions for discontinuing the compression heating may be confirmed for the controller to discontinue the compression heating.

If the conditions for discontinuing the compression heating are not met, for example, if the engine temperature is not greater than the threshold temperature, method 400 returns to 408 to continue performing the compression heating in the subset of cylinders. If the conditions for discontinuing the compression heating are met, method 400 proceeds to 416 to activate the deactivated exhaust valves and commence fueling in all of the cylinders. With fueling provided and the exhaust valve of each cylinder active and operational, spark is also provided to each cylinder so that combustion may occur in all of the cylinders. For example, the cylinders operating in the compression heating mode may be transitioned to operating in the combustion mode. Furthermore, with combustion resumed in all of the cylinders, engine operating parameters may be adjusted. For example, one or more of airflow, spark timing, and cylinder valve timing may be adjusted in order to maintain the engine torque demand and minimize torque disturbances when combustion resumes in all of the engine cylinders. In some examples, the engine may transition from operation in the SPCCI mode to operation in the SI mode. As such, one or more of a desired AFR, a fuel injection amount or split ratio, and a cylinder compression ratio may also be adjusted. For example, the desired AFR may be adjusted from a lean AFR for operation in the SPCCI mode to stoichiometry for operating in the SI mode. As another example, the compression ratio may be decreased from a higher compression ratio while operating in the SPCCI mode to a lower compression ratio while operating in the SI mode to avoid engine knock. The compression ratio may be adjusted by actuating a VCR mechanism (e.g., VCR mechanism 194 of FIG. 1) via a VCR actuator (e.g., a VCR actuator 193 of FIG. 1). Following 416, method 400 ends.

In this way, by performing continued compression heating of the intake air and the in-cylinder air even after the first firing event, the engine may continue to benefit from enhanced mixture preparation, resulting in more complete combustion. For example, fuel economy may be increased while vehicle emissions are reduced. Furthermore, operation in the SPCCI mode may be aided through increased intake air (and thus air charge) temperatures, which may further increase fuel economy and further reduce vehicle emissions while increasing an efficiency of the engine.

Thus, in one example, the method of FIG. 4 may include determining an air heating condition, and in response thereto, transitioning one or more cylinders to a compression heating mode; and a non-heating condition, and in response thereto, operating all of the cylinders in a combustion mode. In some examples, operating one or more cylinders in the compression heating mode occurs while or during the air heating condition, and operating all of the cylinders in the combustion mode occurs while the air heating condition is not present and/or while or during the non-heating condition. Further, instructions stored in memory may include instructions for determining the air heating condition from one or more of an engine coolant temperature sensor and an indication to operate in a spark-controlled compression ignition mode, and in response, operating one or more cylinders to the compression heating mode by instructions for sending a set of signals to an actuator of an exhaust valve of each of the one or more cylinders and a fuel injector coupled to each of the one or more cylinders; and determining the non-air heating condition from one or more of the engine coolant temperature sensor and an indication to operate in a spark ignition mode, and in response, operating all of the cylinders in the combustion mode by instructions for sending a different set of signals to the actuator of the exhaust valves and the fuel injectors coupled to each cylinder. In some examples, the method may include determining whether to perform one or more of each of operating one or more cylinders in the compression heating mode and operating all of the cylinders in the combustion mode based on a determination of whether the air heating condition is present or absent. Further, while the one or more cylinders are operating in the compression heating mode, a remaining number of cylinders may be operated in the combustion mode. In some examples, a given cylinder may be transitioned from the combustion mode to the compression heating mode and back to the compression mode so that the given cylinder alternates between operating in the combustion mode and the compression heating mode every engine cycle while the air heating condition is present.

Figure 5:
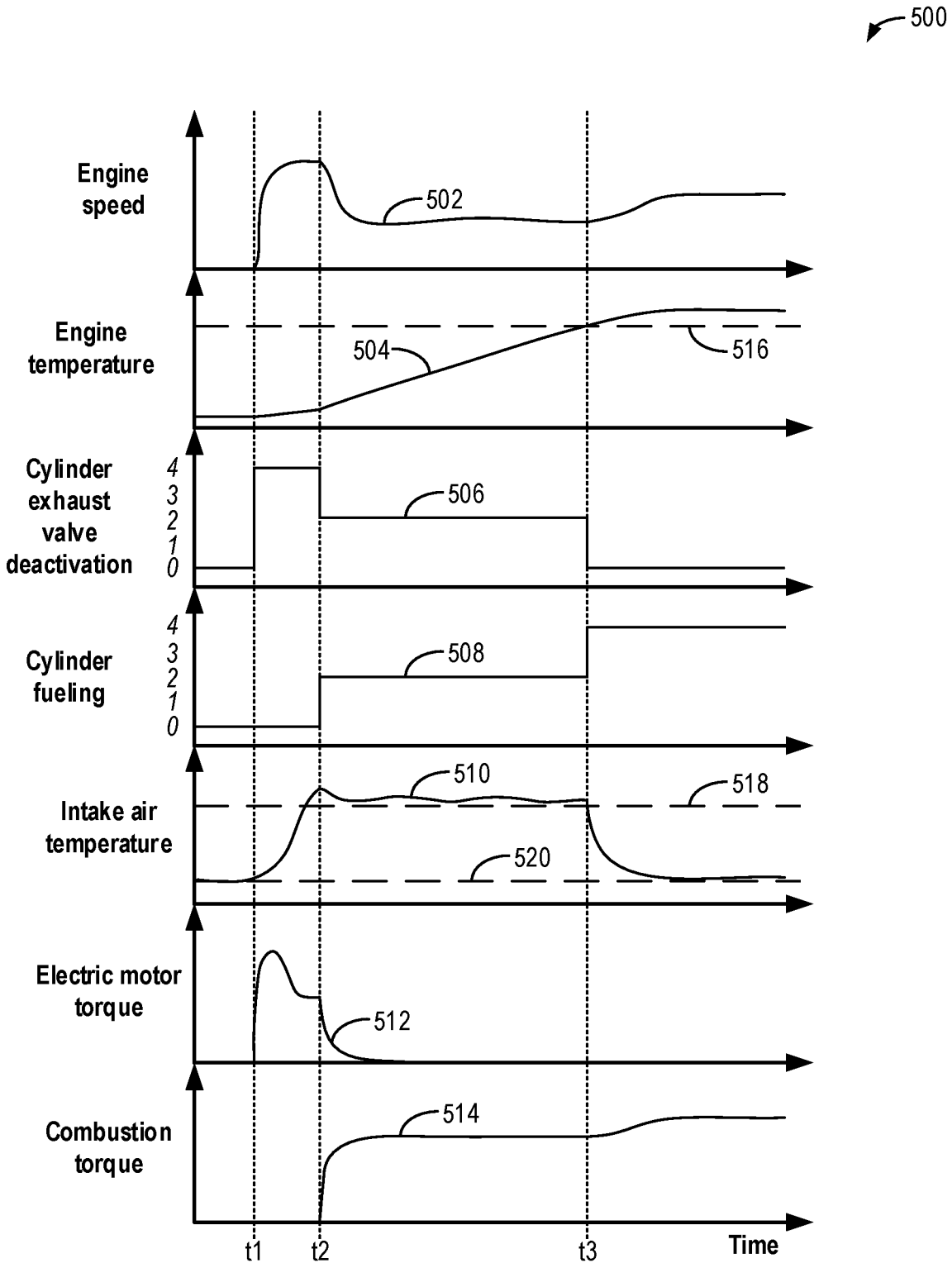
FIG. 5 illustrates a prophetic example timeline showing compression heating of air via exhaust valve deactivation during an engine start and after the engine start.

Next, FIG. 5 shows an example graph 500 of operating an engine in a vehicle (e.g., engine 10 of vehicle 5 shown in FIG. 1) to heat air prior to an initial combustion event and after the initial combustion event. For example, engine cylinders may be transitioned between a compression heating mode and a combustion mode according to the example methods of FIGS. 3 and 4. Engine speed is shown in plot 502, engine temperature is shown in plot 504, cylinder exhaust valve deactivation is shown in plot 506, cylinder fueling is shown in plot 508, inferred intake air temperature is shown in plot 510, electric motor torque is shown in plot 512, and combustion torque is shown in plot 514. For all of the above, the horizontal axis represents time, with time increasing along the horizontal axis from left to right. The vertical axis represents each labeled parameter. For plots 502, 504, 510, 512, and 514, values increase up the vertical axis from bottom to top. For plots 506 and 508, the vertical axis represents a number of cylinders experiencing exhaust valve deactivation and fueling, respectively, as labeled (e.g., 0, 1, 2, 3, or 4). Thus, in the example of graph 500, the engine is a four-cylinder engine. Furthermore, in the example of graph 500, each exhaust valve (e.g., exhaust valve 156 of FIG. 1) is able to be selected for deactivation.

Prior to time t1, the engine is off and at rest, as indicated by an engine speed of zero (plot 502) and a combustion torque of zero (plot 514). Furthermore, an electric motor (e.g., electric machine 52 of FIG. 1) does not supply electric motor torque to rotate the engine (plot 512). With the engine off, the engine temperature (plot 504) is low, and the inferred intake air temperature (plot 510) is equal to ambient temperature (indicated by a dashed line 520). Furthermore, none of the engine cylinders are fueled while the engine is off (plot 508). The exhaust valves may be in a default active state while the engine is off, and thus, none of the exhaust valves are deactivated (plot 506).

At time t1, an engine start is requested by a vehicle operator. As a result, the engine is transitioned to operating in the compression heating mode. Specifically, the exhaust valve of every cylinder (e.g., all four cylinders) is deactivated (plot 506), and the engine remains unfueled (plot 508). A controller (e.g., controller 12 of FIG. 1) determines a number of engine cycles to operate every cylinder in the compression heating mode prior to a first combustion event based on the intake air temperature (plot 510) at time t1, which is equal to ambient temperature (dashed line 520), and a desired intake air temperature (indicated by a dashed line 518).

Between time t1 and time t2, the engine is cranked from rest via electric motor torque (plot 512) to bring the engine speed (plot 502) to a high cranking speed. The amount of electric motor torque is initially higher in order to accelerate the engine from rest, and then decreases to maintain the engine speed at the high cranking speed. As the engine is cranked for the determined number of engine cycles between time t1 and time t2 with the exhaust valves deactivated, the intake air temperature (plot 510) surpasses the desired intake air temperature (dashed line 518). Without combustion occurring in the engine cylinders between time t1 and time t2, the combustion torque remains at zero (plot 514) and the engine temperature increases a small amount (plot 504) due to friction and heat transfer from the intake air.

Upon completion of the final engine cycle of the determined number of engine cycles at time t2 and in response to the engine temperature (plot 504) being less than a threshold engine temperature representing a steady state operating temperature (indicated by a dashed line 516), two of the engine cylinders (e.g., a subset) continue to operate in the compression heating mode, unfueled and with their exhaust valves deactivated (plot 506). The remaining two cylinders are transitioned to operating in the combustion mode, with fuel provided (plot 508) and their exhaust valves active. Furthermore, spark is provided in the cylinders operating in the combustion mode (not shown) to initiate combustion. As a result of the two cylinders operating in the combustion mode, the combustion torque increases (plot 514). The combustion torque (plot 514) increases gradually due to a lower density air charge (e.g., due to the increased intake air temperature and in-cylinder temperature), with the electric motor torque (plot 512) decreasing a corresponding amount until the electric motor torque is reduced to zero. Furthermore, the engine speed (plot 502) decreases to a lower idle speed than the high cranking speed (between time t1 and time t2).

With two (e.g., half) of the cylinders operating in the compression heating mode between time t1 and time t2, the intake air temperature (plot 510) remains above the desired intake air temperature (dashed line 518), and the engine temperature (plot 504) rapidly increases. In the example of graph 500 of FIG. 5, each engine cylinder alternates between operating in the compression heating mode and operating in the combustion mode between time t2 and time t3. That is, a first set of two cylinders is operated in the combustion mode while a second set of two cylinders is operated in the compression heating mode during a first engine cycle, the first set of two cylinders is operated in the compression heating mode while the second set of two cylinders is operated in the combustion mode during a second engine cycle, the first set of two cylinders is operated in the combustion mode while the second set of two cylinders is operated in the compression heating mode during a third engine cycle, etc. In this way, each of the four engine cylinders is alternately operated in the combustion heating mode (e.g., fired) and operated in the compression heating mode (e.g., unfired) for uniform engine and gas heating.

At time t3, the engine temperature (plot 504) reaches the threshold engine temperature (dashed line 516). As a result, the two cylinders operating in the compression heating mode are transitioned to operating in the combustion mode. None of the cylinder exhaust valves are deactivated (plot 506), and fuel is provided to all four cylinders (plot 508). Spark is provided to ignite an air-fuel mixture within each cylinder (not shown). As described with respect to FIG. 4, operating parameters, such as engine load, spark timing, etc. are adjusted to minimize torque disturbances. However, the combustion torque and the engine speed may vary based on operator demand, as shown in plots 514 and 512, respectively. Without the compression heating of the gas, the intake air temperature decreases (plot 510). However, with the engine warm and operating above the threshold engine temperature, the lower intake air temperature does not substantially impact combustion completion.

In this way, by heating air (e.g., intake air and air charge) of an engine prior to a first combustion event by deactivating cylinder exhaust valve while spinning the engine unfueled, engine efficiency may be increased while vehicle emissions are reduced. In particular, the heated air increases fuel vaporization and air-fuel mixture uniformity, resulting in a more complete initial combustion reaction. Furthermore, the reduced air charge (due to the lower density of the heated air) enables an amount of combustion torque produced by the engine to be gradually increased. Further still, by operating a subset of the engine cylinders in a compression heating mode (e.g., with corresponding exhaust valves deactivated and fueling disabled to the subset) after the first combustion event, on-going air heating may be provided for continued increased engine efficiency and decreased vehicle emissions. In particular, the on-going air heating may increase combustion completion while the engine is colder (e.g., not warmed up to a steady state operating temperature)

or facilitate operation in a higher efficiency spark-controlled combustion ignition mode. As a result, fuel economy may be further increased.

The technical effect of operating one or more engine cylinders unfueled and with exhaust valves maintained closed is that a temperature of engine intake air and in-cylinder air is increased via compression heating, resulting in increased fuel vaporization, increased air-fuel mixture uniformity, increased fuel economy, and decreased emissions during a subsequent combustion event.

As one example, a method for a hybrid electric vehicle comprises: during an engine start, deactivating engine cylinder exhaust valves while activating engine cylinder intake valves and electrically spinning the engine unfueled until reaching a threshold intake air temperature; and after reaching the threshold intake air temperature, activating and fueling one or more of the cylinders to initiate combustion, and then alternating between deactivating and combusting in the one or more cylinders until reaching a threshold engine temperature. In the preceding example, additionally or optionally, deactivating the one or more cylinders includes maintaining the exhaust valves of the one or more cylinders closed and maintaining activation of the intake valves of the one or more cylinders while disabling fueling to the one or more cylinders over an engine cycle. In any or all of the preceding examples, additionally or optionally, combusting in the one or more cylinders includes lifting the intake valve and the exhaust valve at corresponding valve timings, providing fuel via a fuel injector coupled to each of the one or more cylinders, and providing spark via a spark plug coupled to each of the one or more cylinders over an engine cycle. In any or all of the preceding examples, additionally or optionally, the intake air temperature is estimated based on an initial intake air temperature, a compression ratio of the engine cylinder, and a number of engine cycles over which the exhaust valves have been deactivated. In any or all of the preceding examples, additionally or optionally, the initial intake air temperature is equal to ambient temperature. In any or all of the preceding examples, additionally or optionally, an air charge is estimated based on the estimated intake air temperature, a pressure of the intake air, and a timing of closing of the intake valves. In any or all of the preceding examples, additionally or optionally, alternately deactivating and combusting in the one or more cylinders includes determining a number and pattern of the one or more cylinders based on at least one of engine torque demand, a current engine temperature, and a configuration of the engine. In any or all of the preceding examples, additionally or optionally, the pattern is the same or different from one engine cycle to the next. In any or all of the preceding examples, additionally or optionally, the threshold engine temperature is a steady-state operating temperature of the engine.

As another example, a method comprises: performing compression heating of gas in one or more cylinders of a multi-cylinder engine before transitioning to a spark-controlled compression ignition mode. In the preceding example, additionally or optionally, the performing the compression heating includes disabling fueling to the one or more cylinders and deactivating exhaust valves of the one or more cylinders while intake valves of the one or more cylinders remain active. In any or all of the preceding examples, additionally or optionally, the gas includes a mixture of fresh air and residual exhaust gas, and performing the compression heating includes discharging at least a portion of the gas from the one or more cylinders to an intake passage via the intake valves. In any or all of the preceding examples, additionally or optionally, the one or more cylinders is equal to every cylinder of the multi-cylinder engine during an engine start from rest, and the method further comprises: determining a number of engine cycles to perform the compression heating based on a desired intake air temperature and an initial intake air temperature via an isentropic compression model; rotating the engine via electric motor torque and without combustion torque for the determined number of engine cycles; commencing the spark-controlled compression ignition combustion in at least one cylinder by activating the exhaust valves of the at least one cylinder and enabling fueling of the at least one cylinder after the determined number of engine cycles; and decreasing the electric motor torque as the combustion torque increases. In any or all of the preceding examples, the method additionally or optionally further comprises determining a number and pattern of cylinders to select as the one or more cylinders based on at least one of torque demand, engine temperature, and hardware restrictions of the engine. In any or all of the preceding examples, additionally or optionally, the determined pattern includes a same one or more cylinders selected for each consecutive engine cycle or a different one or more cylinders selected for each consecutive engine cycle.

As another example, a system comprises: an engine including a plurality of cylinders coupled to a crankshaft, each cylinder including a piston, an intake valve, an exhaust valve, a spark plug, and a fuel injector coupled directly thereto; an electric motor coupled to the crankshaft receiving electrical power from a system battery; an intake manifold for supplying intake air to each cylinder via the intake valve; a first temperature sensor for estimating an engine temperature; a second temperature sensor for estimating an ambient temperature; a pressure sensor coupled to the intake manifold for measuring an intake air pressure; and a controller storing executable instructions in non-transitory memory that, when executed, cause the controller to: operate each of the plurality of cylinders in a compression heating mode for a number of engine cycles prior to an initial firing, the number of engine cycles determined based on the ambient temperature and a desired intake air temperature, while spinning the engine via the electric motor; and operate a subset of the plurality of cylinders in the compression heating mode and remaining cylinders in a combustion mode after the initial firing in response to conditions for compression heating met. In the preceding example, additionally or optionally, the compression heating mode includes deactivating the exhaust valve while maintaining the intake valve active, not injecting fuel via the fuel injector, and not providing a spark via spark plug, and the combustion mode includes maintaining the intake valve and the exhaust valve active, providing fuel via the fuel injector, and providing the spark via the spark plug. In any or all of the preceding examples, additionally or optionally, the conditions for compression heating include the engine temperature being less than a threshold temperature, the threshold temperature corresponding to steady state engine operation. In any or all of the preceding examples, additionally or optionally, a fuel amount for the initial firing is determined based on the number of engine cycles, the ambient temperature, and the intake air pressure. In any or all of the preceding examples, additionally or optionally, a number of cylinders in the subset of the plurality of cylinders is determined based on at least one of a torque demand and the engine temperature.

In another representation, a method comprises: deactivating one or more cylinders of a multi-cylinder engine by disabling fueling to the one or more cylinders and deactivating exhaust valves of the one or more cylinders in response to at least one of an engine start request, an engine temperature less than a threshold temperature, and operation in a spark-controlled compression ignition mode. In the previous example, additionally or optionally, intake valves of the one or more cylinders remain active during the deactivating. In any or all of the previous examples, the one or more cylinders includes every cylinder of the multi-cylinder engine in response to the engine start request. In any or all of the preceding examples, the method further comprises determining a number of engine cycles to maintain the one or more cylinders deactivated. In any or all of the preceding examples, additionally or optionally, the number of engine cycles is determined based on at least one of an intake air temperature and the engine temperature. In any or all of the preceding examples, the method further comprises determining a number and identity of the one or more cylinders. In any or all of the preceding examples, the number and identity of the one or more cylinders is determined based on at least one of an engine torque demand and a configuration of the multi-cylinder engine.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for a hybrid electric vehicle, comprising:

during starting of an engine, deactivating engine cylinder exhaust valves while activating engine cylinder intake valves and electrically spinning the engine unfueled until an intake air temperature reaches a threshold; and after reaching the threshold, activating and fueling one or more cylinders to initiate combustion, and then alternating between deactivating and combusting in the one or more cylinders until reaching a threshold engine temperature.

2. The method of claim 1, wherein deactivating the one or more cylinders includes maintaining the exhaust valves of the one or more cylinders closed and maintaining activation of the intake valves of the one or more cylinders while disabling fueling to the one or more cylinders over an engine cycle.

3. The method of claim 1, wherein combusting in the one or more cylinders includes lifting the intake valves and the exhaust valves at corresponding valve timings, providing fuel via a fuel injector coupled to each of the one or more cylinders, and providing spark via a spark plug coupled to each of the one or more cylinders over an engine cycle.

4. The method of claim 1, wherein the intake air temperature is estimated based on an initial intake air temperature, a compression ratio of the one or more cylinders, and a number of engine cycles over which the exhaust valves have been deactivated.

5. The method of claim 4, wherein the initial intake air temperature is equal to ambient temperature.

6. The method of claim 4, wherein an air charge is estimated based on the estimated intake air temperature, a pressure of the intake air, and a timing of closing of the intake valves.

7. The method of claim 1, wherein alternately deactivating and combusting in the one or more cylinders includes determining a number and pattern of the one or more cylinders based on at least one of engine torque demand, a current engine temperature, and a configuration of the engine.

8. The method of claim 7, wherein the pattern is the same or different from one engine cycle to the next.

9. The method of claim 1, wherein the threshold engine temperature is a steady-state operating temperature of the engine.

10. A method, comprising:

performing compression heating of gas in one or more cylinders of a multi-cylinder engine before transitioning to a spark-controlled compression ignition mode including disabling fueling to the one or more cylinders and deactivating exhaust valves of the one or more cylinders while intake valves of the one or more cylinders remain active.

11. The method of claim 10, wherein the gas includes a mixture of fresh air and residual exhaust gas, and performing the compression heating includes discharging at least a portion of the gas from the one or more cylinders to an intake passage via the intake valves.

12. The method of claim 10, wherein the one or more cylinders is equal to every cylinder of the multi-cylinder engine during an engine start from rest, and the method further comprises:

determining a number of engine cycles to perform the compression heating based on a desired intake air temperature and an initial intake air temperature via an isentropic compression model;

rotating the engine via electric motor torque and without combustion torque for the determined number of engine cycles;

commencing spark-controlled compression ignition combustion in at least one cylinder by activating the exhaust valves of the at least one cylinder and enabling fueling of the at least one cylinder after the determined number of engine cycles; and decreasing the electric motor torque as the combustion torque increases.

13. The method of claim 10, further comprising:

determining a number and pattern of cylinders to select as the one or more cylinders based on at least one of torque demand, engine temperature, and hardware restrictions of the engine.

14. The method of claim 13, wherein the determined pattern includes a same one or more cylinders selected for each consecutive engine cycle or a different one or more cylinders selected for each consecutive engine cycle.

15. A system, comprising:

an engine including a plurality of cylinders coupled to a crankshaft, each cylinder including a piston, an intake valve, an exhaust valve, a spark plug, and a fuel injector coupled directly thereto;

an electric motor coupled to the crankshaft receiving electrical power from a system battery;

an intake manifold for supplying intake air to each cylinder via the intake valve;

a first temperature sensor for estimating an engine temperature;

a second temperature sensor for estimating an ambient temperature;

a pressure sensor coupled to the intake manifold for measuring an intake air pressure; and a controller storing executable instructions in non-transitory memory that, when executed, cause the controller to:

operate each of the plurality of cylinders in a compression heating mode for a number of engine cycles prior to an initial firing, the number of engine cycles determined based on the ambient temperature and a desired intake air temperature, while spinning the engine via the electric motor; and operate a subset of the plurality of cylinders in the compression heating mode and remaining cylinders in a combustion mode after the initial firing in response to conditions for compression heating are met.

16. The system of claim 15, wherein the compression heating mode includes deactivating the exhaust valve while maintaining the intake valve active, not injecting fuel via the fuel injector, and not providing a spark via the spark plug, and the combustion mode includes maintaining the intake valve and the exhaust valve active, providing fuel via the fuel injector, and providing the spark via the spark plug.

17. The system of claim 15, wherein the conditions for compression heating include the engine temperature being less than a threshold temperature, the threshold temperature corresponding to steady state engine operation.

18. The system of claim 15, wherein a fuel amount for the initial firing is determined based on the number of engine cycles, the ambient temperature, and the intake air pressure.

19. The system of claim 15, wherein a number of cylinders in the subset of the plurality of cylinders is determined based on at least one of a torque demand and the engine temperature.

* * * * *